US006321669B1

(12) United States Patent
Park

(10) Patent No.: US 6,321,669 B1
(45) Date of Patent: Nov. 27, 2001

(54) THREADLESS EMBROIDERY METHOD

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 0 days.

(21) Appl. No.: 09/745,729

(22) Filed: Dec. 26, 2000

(51) Int. Cl.[7] ..... D05C 15/04
(52) U.S. Cl. ..... 112/475.18
(58) Field of Search ..... 112/475.18, 475.22, 112/475.23, 475.11; 28/109, 107, 163; 26/69 R; 223/18

(56) References Cited

U.S. PATENT DOCUMENTS 298,025 * 5/1884 Pulaski ..... 112/475.18
4,205,113 * 5/1980 Hermansson et al. ..... 28/109
4,379,189 * 4/1983 Platt ..... 28/109
5,144,730 * 9/1992 Dilo ..... 28/109
5,418,981 5/1995 Miner .
5,592,891 1/1997 Muto .
5,599,416 2/1997 Kuwahara .
5,674,591 10/1997 James et al. .
5,954,004 9/1999 Futamura .
6,101,962 8/2000 Hinshaw .

* cited by examiner

*Primary Examiner*—Ismael Izaguirre
(74) *Attorney, Agent, or Firm*—Jacobson Holman, PLLC

(57) ABSTRACT

A threadless embroidery method for textile products and the like, includes the steps of forming a design in a mirror-like fashion on a fabric material, applying a threadless embroidery needle to the reverse side of the fabric material and moving the threadless needle up and down continuously following the design pattern formed on the fabric material, and thereby breaking the surface of the fabric structure thus creating a fuzz texture forming the design on the surface of the fabric material.

13 Claims, 2 Drawing Sheets

THREADLESS EMBROIDERY METHOD

BACKGROUND OF THE INVENTION

1. Field of the Invention

The present invention relates to a threadless embroidery method for textile products and the like and, more particularly, to a threadless embroidery process that creates a breaking of a fabric material by a threadless embroidery needle so that a fuzz texture formed by the broken fabric creates a design pattern on the fabric material of the textile product.

2. Description of the Prior Art

Typically, embroidery has been used when presenting decorative designs or labels on textile products or the like. As the form of embroidery diversified, embroidery employing several layers to create a three-dimensional effect as well as the standard one layer plane embroidery have come into practice. These diversified forms lead to complex embroidery processes and increased embroidery time. The increase in the time to embroider by the machines cause difficulties when mass producing products. The problems that arise and slow the process are caused by the entanglement of embroidery thread during an embroidery process. Additionally, the snapping of embroidery thread caused by the speed of the embroidery machine frequently occurs. More delays are caused by having to change the embroidery thread each time when a different type of thread is required according to the embroidery method involved. Each of these problems causes an increase in the embroidery manufacturing time.

Of course, there have been numerous attempts to eliminate the noted problems in the embroidery method of manufacturing. On such attempt is found in U.S. Pat. No. 5,418,981 to Miller. This patent relates to baseball style adjustable caps, and more particularly to an emblem bearing cap attachment for such caps. Here, the embroidery method was basically eliminated in order to solve the noted problems.

In U.S. Pat. No. 5,592,891 to Muto, there is an embroidery data processing apparatus which processes embroidery data needed to control a sewing machine to form an embroidery pattern on one or more work sheets. In particular, the patent describes to such an apparatus for processing embroidery data which commands a sewing machine to form a shadowed embroidery pattern including an original embroidery pattern and one or more shadow embroidery patterns.

Another attempt is found in U.S. Pat. No. 5,599,416 to Kawahara. This patent relates to a thermally transferable type emblem or ornamental decoration piece made of a thermoplastic synthetic resin to be suitably used to apply a design by heating and pressing it on the surface of an object such as clothing, bags, sports or office equipment, stationery made of fiber, textile, synthetic resin, leather, and metal.

U.S. Pat. No. 5,674,591 to James et al. is directed to nonwoven fabrics having a fibrous background portion in one plane thereof and raised fibrous portions in another plane thereof. There may be two types of raised fibrous portions in another plane thereof, and there may be two types of raised portions. The basis weight of the first type of raised portion is substantially the same as the basis weight of the background portion of the non-woven fabric. The basis weight of the second type of raised potion is greater than the basis weight of the background portion.

U.S. Pat. No. 5,954,004 to Futamura relates to a method of generating embroidery data and more specifically to a method of setting a stitch pattern for an embroidery region and also to a device capable of setting the same and a program storage medium storing a program of setting the same.

U.S. Pat. No. 6,101,962 to Hinshow relates to embroidery and more particularly to a method for performing shadow work embroidery with a sewing machine which yields shadow work embroidery that looks like fine shadow work embroidery performed by hand.

However, none of the noted prior art patents have been able to eliminate the problem of an embroidery thread being snapped or becoming tangled during an embroidery process. Additionally, the prior art embroidery are slow and remain expensive because of the use of the embroidery thread.

SUMMARY OF THE INVENTION

To carry out the noted objects and other objects of the present invention, a desired design to be embroidered is formed in a mirror-like fashion on a fabric material, and a threadless embroidery needle is applied to the back side of the fabric material. Then, the threadless needle is moved up and down continuously following the design pattern of the fabric material thereby breaking the front surface of the fabric structure creating a fuzz texture forming the design on the front surface of the fabric material.

It is preferred that a textile material high in density that is easily broken, such as cotton, is used when employing the threadless embroidery method of the present invention.

In the process of embroidery, the actual operation of the threadless embroidery needle occurs on the opposite side of the fabric material from which a design pattern is to be presented. Thus, a design drawing and a punching process occur in a mirror-like fashion in a reverse method to general practices of embroidery drawing and punching of textile products. Also, when punching, a tatami technique, a well-known fill stitch technique to those skilled in the art, is used to embroider approximately 200% more finely than general embroidery so as to sufficiently break the fabric structure.

There are two possible ways to control the extent of breakage of the fabric structure, one of which is to reinforce the number of stitches. Another way is to adjust the needle size. The first method of reinforcing the number of stitches is accomplished by increasing the rotation frequency of the embroidery machine engine thus reducing the overall time needed to embroider. When the second method of adjusting the needle size is used, it is preferred rather than an ordinary plane embroidery needle to facilitate the breakage of the fabric material. Thus, textile products embroidered by the method of the present invention have a design pattern presented on the opposite side of the fabric from which the embroidery has occurred to present an effect of a scratched surface design.

Therefore, it is an object of the present invention to provide a threadless embroidery method that simplifies the embroidery process.

A further object of the present invention is to increase the rotation frequency of the embroidery machine engine to reduce the time required to embroider.

A still further object of the present invention is to utilize the fuzz texture formed by the broken fabric material as a result of the action of a threadless needle to present a design pattern created by a novel embroidery method.

An object of the invention is to have textile products and the like characterized by a threadless embroidery method wherein a design to be embroidered is formed in a mirror-like fashion on a fabric material.

A further object of the invention is to provide a threadless embroidery needle that is moved up and down continuously over a back side of the fabric material following the mirror-like design formed on a reverse side of the fabric material to break the fabric structure forming a fuzz texture on the front side of the fabric material.

Another object of the invention is to provide the fuzz texture created by the movement of the threadless embroidery needle forming the design on the front side of said fabric material.

It is an object of the invention is that the breakage of the fabric material is controlled by either reinforcing the number of embroidery stitches or by adjusting the size of the embroidery needle.

A further object of the invention is that the fabric material used is cotton.

Another object of the invention is that the fabric product is a baseball style cap with a visor projecting forward from the crown.

Another object of the invention is that the fabric products are garments.

It is an object of the invention that the fabric products are handbags and the like.

Another object of the invention is that the fabric products are footwear.

It is an object of the invention to provide a threadless embroidery method for textile products and the like by forming a design to be embroidered in a mirror-like fashion on a fabric material.

It is a further object of the invention to move a threadless embroidery needle up and down continuously over the back side of the fabric material following the mirror-like design formed on the reverse side to break the fabric structure to form a fuzz texture on the front side of the fabric material.

Another object of the invention is that the fuzz texture created by the movement of the threadless embroidery needle forms the design on the front side of said fabric material.

A further object of the invention is that the threadless embroidery method employs a tatami technique.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
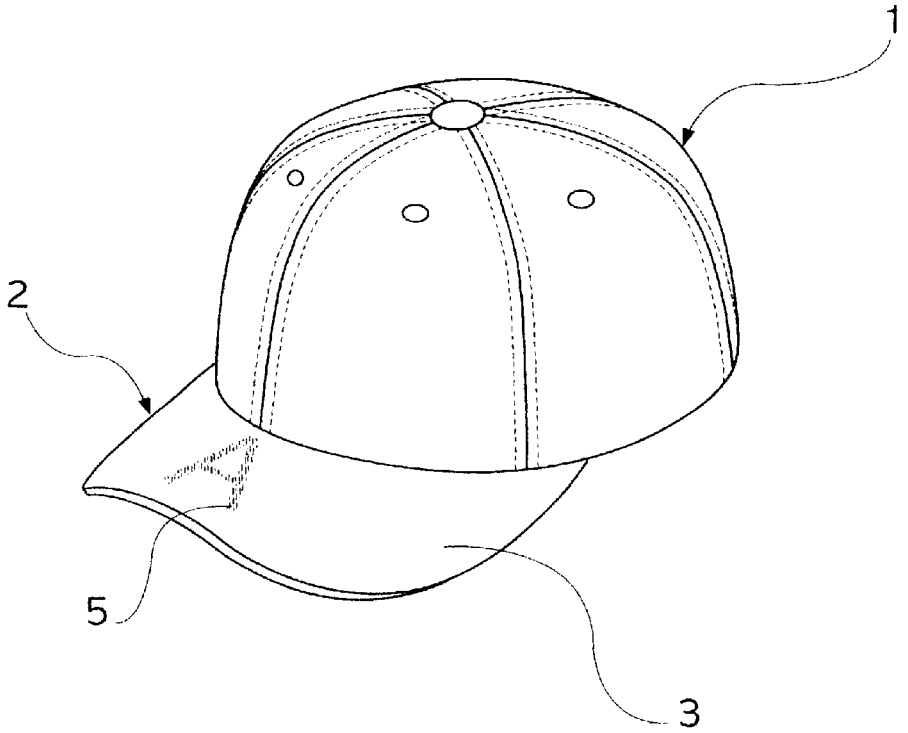
FIG. 1 is a perspective view of a preferred embodiment of the present invention.

Although only a few preferred embodiments of the invention are explained in detail, and it is to be understood that the embodiments are given by way of illustration only. It is not intended that the invention is to be limited in its scope to the details of construction and arrangement of components set forth in the following description of illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Figure 2:
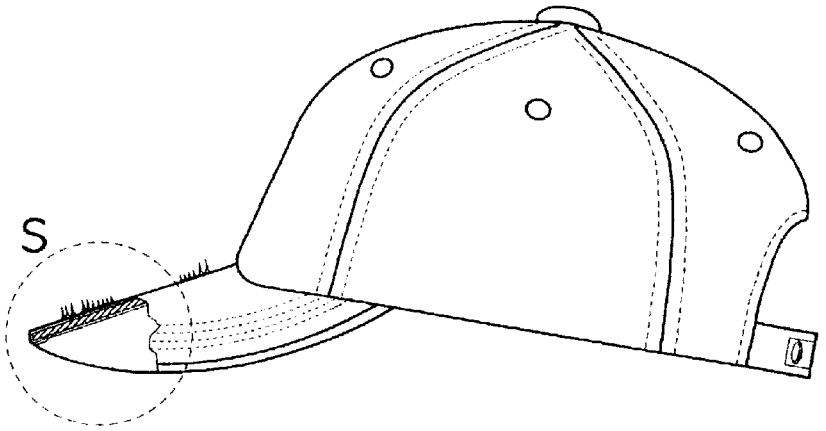
FIG. 2 is a side view of a preferred embodiment of the present invention.

In accordance with the preferred embodiment of the present invention, FIG. 1 is a perspective view of a baseball style cap with a fuzz texture design created by a threadless embroidery needle on an upper visor. FIG. 2 is a side view of a baseball style cap with a fuzz texture design created by a threadless embroidery needle showing a section of a visor that has been embroidered with a threadless needle.

Figure 3:
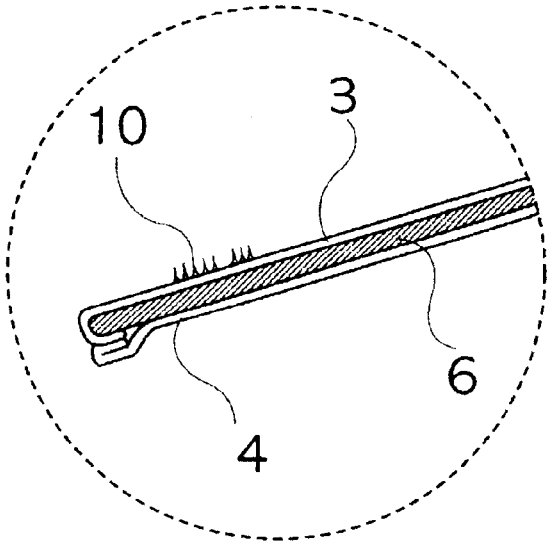
FIG. 3 is an enlarged partial view of part S of FIG. 2.

FIG. 3 is an enlarged partial view of part S of FIG. 2 showing a fuzz texture created on the upper visor.

Figure 4:
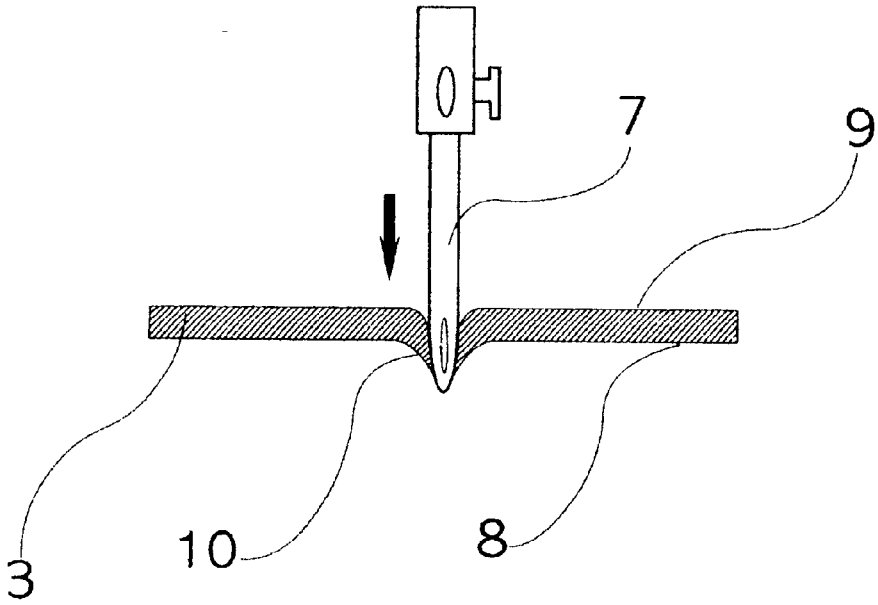
FIG. 4 is a front view of a threadless embroidery needle of the present invention in the process of embroidering.

In a preferred embodiment of the present invention, and in particular to a baseball style cap, a design pattern to be embroidered is drawn on a certain position on fabric 3 and a threadless embroidery needle 7 is used to move up and down over the back side of the fabric 9 to break the fabric structure to form a fuzz texture 10 on the front side of the fabric 8, the fuzz texture 10 creating a design 5 on the front side of the fabric 3, as better illustrated in FIG. 4.

In a baseball style cap the fuzz texture created by the broken fabric structure to form an embroidered design is formed on the upper visor 2 of the cap.

Referring to FIG. 3, a visor portion is formed by a peak 6 covered by upper and lower fabric material 3, 6. In the drawings of the preferred embodiment of the present invention, a threadless embroidered pattern is only presented on the upper visor 3. However, alternatively a same method of threadless embroidery may be applied on the lower visor 4 as well as a crown portion 1 of FIG. 1 to present a fuzz textured design.

FIG. 4 shows a embroidery process of the present invention in which the back side 9 of the fabric 3 is embroidered. In a fashion opposite to a general embroidery process, the threadless embroidery needle 7 moves up and down continuously to break the structure of fabric material 3 to create a fuzz texture 10 on the front side 8 of the fabric 3, and the fuzz texture forms a design on the fabric. The threadless embroidery needle 7 is moved up and down using a tatami technique to finely fill in the design to present a more distinct appearance.

In the embroidery process of the present invention, the embroidery needle 7 does not use embroidery thread thus the problem of an embroidery thread getting tangled, and the time delay caused by changing the embroidery thread is eliminated so that the embroidery process is simplified. By increasing the rotation frequency of the embroidery machine engine the overall time required to embroider is reduced. Also, because there is no embroidery thread used, the overall production cost is reduced.

A textile product or the like embroidered by the threadless embroidery method of the present invention is easily produced and presents a clean, three-dimensional type design with a faded, soft, aesthetically pleasing effect.

It is preferred that the threadless embroidery method of the present invention is carried out as described above in a mirror-like fashion to minimize the number of stitches required. However, if a design is drawn in a normal fashion on a front side of a fabric material, the design should be embroidered threadless from the front side of the fabric as is conventional.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. A threadless embroidery method for manufacturing textile products, said method comprising steps of:

providing a fabric product to be embroidered, said fabric product being formed of a fabric material having an inner fabric structure;

providing a design to be embroidered on said fabric material;

forming said design to be embroidered in a mirror-like fashion on said fabric material;

applying a threadless embroidery needle;

moving said threadless embroidery needle up and down continuously over a back side of the fabric material following the mirror-like design formed on a front side of the fabric material;

breaking the fabric material and through the fabric structure with said continuously moving threadless embroidery needle, wherein the step of breaking of said fabric material is controlled by reinforcing the number of up and down movement of said threadless embroidery needle; and forming a fuzz texture on the front side of the fabric material, said fuzz texture created by the movement of said threadless embroidery needle forming the design on the front side of said fabric material.

2. The threadless embroidery method as defined in claim 1, wherein the step of providing the fabric material includes selecting cotton as the fabric material.

3. The threadless embroidery method as defined in claim 1, wherein the step of providing the fabric product includes providing a baseball style cap with a visor projecting forwardly from a crown of said baseball style cap.

4. The threadless embroidery method as defined in claim 1, wherein the fabric products are garments.

5. The threadless embroidery method as defined in claim 1, wherein the fabric products are handbags.

6. The threadless embroidery method as defined in claim 1, wherein the fabric products are footwear.

7. The threadless embroidery method as defined in claim 1, wherein the step of breaking of said fabric material is controlled by adjusting the size of the embroidery needle.

8. A threadless embroidery method for manufacturing textile products, comprising steps of:

forming a design to be embroidered in a mirror-like fashion on a fabric material;

moving a threadless embroidery needle up and down continuously over a back side of the fabric material following the mirror-like design formed on the back side to break the fabric structure to form a fuzz texture on a front side of the fabric material, wherein the step of moving is controlled by reinforcing the number of up and down movement of the threadless embroidery needle; and said fuzz texture created by the movement of said threadless embroidery needle forming the design on the front side of said fabric material.

9. The threadless embroidery method as defined in claim 8, wherein the fabric material is cotton.

10. The threadless embroidery method as defined in claim 8, wherein the manufactured textile products are used for garments.

11. The threadless embroidery method as defined in claim 8, wherein the manufactured textile products are used for handbags.

12. The threadless embroidery method as defined in claim 8, wherein the manufactured textile products are used for footwear.

13. The threadless embroidery method as defined in claim 8, wherein the step of moving a threadless embroidery needle is controlled by adjusting the size of the embroidery needle.

* * * * *